United States Patent [19]

Yamaoki et al.

[11] Patent Number: 4,961,094

[45] Date of Patent: Oct. 2, 1990

[54] ELECTROSTATIC RECORDING APPARATUS AND METHOD FOR PRODUCING COLOR IMAGES

[75] Inventors: Toshihiko Yamaoki, Osaka; Kenichiro Wakisaka, Hirakata; Kouji Minami, Higashiosaka; Masayuki Iwamoto, Itami, all of Japan

[73] Assignee: Sanyo Electric Co., Ltd., Osaka, Japan

[21] Appl. No.: 200,660

[22] Filed: May 31, 1988

[30] Foreign Application Priority Data

Jun. 3, 1987 [JP] Japan ..... 62-139231
Oct. 16, 1987 [JP] Japan ..... 62-262447
Oct. 16, 1987 [JP] Japan ..... 62-262448

[51] Int. Cl.[5] ..... G03G 15/01

[52] U.S. Cl. ..... 355/326; 355/242; 355/245; 355/266

[58] Field of Search ..... 355/242, 245, 246, 266, 355/267, 326, 327, 328

[56] References Cited

U.S. PATENT DOCUMENTS 3,672,884 6/1972 Mayer ..... 355/242 X
3,761,951 9/1973 Inoue et al. ..... 355/242 X
4,540,272 9/1985 Abe et al. ..... 355/327
4,791,452 12/1988 Kasai et al. ..... 355/246 X

*Primary Examiner*—Fred L. Braun
*Attorney, Agent, or Firm*—Darby & Darby

[57] ABSTRACT

An electrostatic recording apparatus includes a photosensitive drum which is charged at +700 V by a first charger. Intensity of the light emitted from an LED array that is downstream from the first charger is adjusted such that a light image having strong intensity and/or a light image having weak intensity can be irradiated to the photosensitive drum. A surface voltage of a portion where the light image having weak intensity is irradiated becomes +400 V. A surface voltage of a portion where the light image having strong intensity is irradiated becomes +100 V. The photosensitive drum is charged at −400 V in the reverse polarity opposite to that of the first charger by a second charger which is arranged downstream from the LED array. As a result, electrostatic latent images of three gradations having voltages of +300 V, 0 V and −300 V respectively are formed on the photosensitive drum. The electrostatic latent images of +300 V and −300 V are respectively developed by developers with a black toner being charged in the negative polarity (−) a red toner being charged in the positive polarity (+).

24 Claims, 8 Drawing Sheets

ELECTROSTATIC RECORDING APPARATUS AND METHOD FOR PRODUCING COLOR IMAGES

BACKGROUND OF THE INVENTION

1. Field of the Invention

The present invention relates to an electrostatic recording apparatus. More specifically, the present invention relates to an electrostatic recording apparatus in which electrostatic latent images of two or more gradations having voltages different from each other are formed on a photosensitive member at essentially the same time and respective electrostatic latent images are developed with toners different in color from each other.

2. Description of the Prior Art

One example of this kind of an electrostatic recording apparatus is disclosed in, for example, Japanese Patent Laying-Open No. 55-59473 laid-open on May 2, 1980. In this prior art, a photosensitive drum having a surface insulating layer is uniformly charged in a first polarity by a first charger, and then, the photosensitive drum is charged by a second charger in a second polarity opposite to the first polarity. Light images having light intensity different from each other are simultaneously irradiated onto the photosensitive drum being charged by the second charger by a first exposing means so as to form electrostatic latent images of two gradations thereon. Thereafter, the photosensitive drum is wholly exposed such that two electrostatic latent images, one of which has a voltage of the positive polarity (+) and the other of which has a voltage of the negative polarity (−) can be simultaneously formed on the photosensitive drum. Then, respective electrostatic latent images are developed with different color toners which are charged in opposite polarities with each other. Thus, in the above described prior art, by developing the two electrostatic latent images at the substantive same time with the different color toners, a two-color toner image can be obtained. However, in the prior art, since it is necessary to wholly expose the photosensitive drum prior to a developing step, there is a problem that such a process becomes complex.

SUMMARY OF THE INVENTION

The present invention is directed at an electrostatic recording apparatus capable of obtaining a mutli-color toner image by a simple process.

An electrostatic recording apparatus in accordance with the present invention comprises a photosensitive member capable of being charged in both polarities. The photosensitive member is uniformly charged in one polarity by a first charging means. Light images having two kinds of light intensity are irradiated to the photosensitive member by an exposing means so as to form electrostatic latent images of two gradations having voltages different from each other. The photosensitive member is then uniformly charged by a second charging means to an opposite plurality to that by the first charging means such that the electrostatic latent images of two gradations are made to have voltages of opposite polarities to each other. The two electrostatic latent images formed on the photosensitive member in opposite polarities are developed by developing means with different color toners, which are respectively charged in opposite polarities to that of the respective electrostatic latent images.

On the photosensitive member, an electrostatic latent image having a voltage lower than a voltage initially charged by the first charging means is formed in one polarity by the light image having weak light intensity irradiated from the exposing means. By the light image having strong light intensity irradiated from the exposing means, an electrostatic latent image having a voltage substantially lower than the initial voltage is formed on the photosensitive member in the same polarity. Therefore, when the photosensitive member is uniformly charged in an opposite polarity to that of the first charging means by the second charging means, the electrostatic latent images of two gradations formed as described above are level-shifted. More specifically, the voltage of the electrostatic latent image which is formed by irradiating no light from the exposing means is level-shifted to a voltage lower than the initial voltage but in the same polarity, the voltage of the electrostatic latent image having a relatively high voltage (which is formed by the light image having weak light intensity) is level-shifted to a voltage of approximately 0V or the vicinity thereof, and the voltage of the electrostatic latent image having a relatively low voltage (which is formed by the light image of strong light intensity) is level-shifted to a voltage in the opposite polarity. Thus, after passing the second charging means, two electrostatic latent images are formed in opposite polarities to each other on the photosensitive member. Therefore, if and when the respective electrostatic latent images are developed with different color toners each of which is charged in the opposite polarity to that of corresponding electrostatic latent image, it is possible to reproduce the respective electrostatic latent images as a multicolor toner image.

In accordance with the present invention, since the developing process is started immediately after the second charging means, as is different from the previously cited Japanese Patent Laying-Open No. 55-59473, it is not necessary to insert an additional step where the photosensitive member is wholly exposed prior to the developing step, and therefore, the whole process becomes simple.

In addition, another example of the electrostatic recording apparatus capable of a two-color printing is disclosed in, for example, Japanese Patent Laying-Open No. 54-130128 laid open on Oct. 9, 1979. In this prior art, a photosensitive member including two-layered photoconductive layers which have spectral sensitivities different from each other and exposing means for exposing the photosensitive member by two kinds of light having different wavelengths are provided such that electrostatic latent images of opposite polarities to each other are formed on the respective photoconductive layers by the respective light having different wavelengths. The electrostatic latent images of opposite polarities are developed by toners being charged in the reverse polarities which are respectively opposite to that of the respective electrostatic latent images. Thus, the electrostatic recording apparatus of this prior art is wholly different from the electrostatic recording apparatus in accordance with the present invention in that the photoconductive member has to be two-layered photoconductive layers and the exposing means needs to be structured so as to emit the light having different wavelengths. Furthermore, it is impossible to combine the previously cited Japanese Patent Laying-Open No.

55-59473 and Japanese Patent Laying-Open No. 54-130128 with each other, and even though the both are forcibly combined with each other, the resulting product is entirely different from the present invention.

Furthermore, other prior art is disclosed in, for example, Japanese Patent Laying-Open No. 54-81855 laid-open on June 29, 1979. In this prior art, electrostatic latent images of two gradations in the positive polarity (+) are formed on a dielectric drum by a stylus head. The electrostatic latent image having a high voltage is subjected to a normal developing with a toner being charged in the reverse polarity opposite thereto, and the electrostatic latent image having a low voltage is subjected to a reverse developing with a toner being charged in the same positive polarity (+) by means of an action of a developing bias voltage. The prior art is wholly different from the electrostatic recording apparatus in accordance with the present invention in that the electrostatic latent images are formed on the dielectric drum by the stylus head not on the photosensitive member by the exposing means. Furthermore, it is impossible to combine the previously cited Japanese Patent Laying-Open No. 55-59473 and/or Japanese Patent Laying-Open No. 54-130128 and Japanese Patent Laying-Open No. 54-81855, even though these prior arts are forcibly combined with each other, the resulting product is entirely different from the present invention.

In one embodiment in accordance with the present invention, a transparent conductive substrate is used as a substrate of the photosensitive member. The transparent conductive substrate can be formed by a glass substrate and transparent conductive film formed thereon, for example. The exposing means irradiates the light to the photoconductive layer through the transparent conductive substrate of the photosensitive member.

In the electrostatic recording apparatus using such a transparent conductive substrate at the back of the developing means, the second exposing means is arranged at the side of the transparent conductive substrate of the photosensitive member. When the light is irradiated to the photosensitive member on which a toner image is formed from the side of the transparent conductive substrate, charging on the portion where the toner image is adhered can be eliminated. Therefore, if another electrostatic latent image is formed on the area other than the portion where the toner image is adhered, it is possible to develop such another electrostatic latent image with another toner. In addition, it is possible to form the other electrostatic latent image on the portion where the toner is previously adhered, thereby "color-mixing", in which different color toners are adhered in an overlapping manner, becomes possible.

In the preferred embodiment, electrostatic latent images of four gradations having voltages different from each other are formed in the same polarity on the photosensitive member by the first exposing means. Thereafter, the photosensitive member is uniformly charged in the reverse polarity opposite to that of the first charging means by the second charging means. Therefore, the voltages of respective electrostatic latent images are level-shifted by the second charging means such that the electrostatic latent images of four gradations are made to include electrostatic latent images of two gradations in one polarity and electrostatic latent images of two gradations in the reverse polarity. Then, the electrostatic latent images having large voltage (in absolute value) in opposite polarities are developed by respective developing means. Next, the photosensitive member is exposed from the side of the transparent conductive substrate by the second exposing means to eliminate the charge being charged on the portion where the toner has been adhered. Therefore, at that time, two electrostatic latent images having relatively small voltages (in absolute value) in opposite polarities remain on the photosensitive member. Thereafter, the remaining electrostatic latent images are respectively developed by the other developing means. Thus, in this preferred embodiment, by forming electrostatic latent images of four gradations on the photosensitive member and developing the same by toners of four colors (the three primary colors and the black), a full-color toner image can be obtained.

In the other preferred embodiment, after the electrostatic latent images being formed by the first exposing means are developed, the photosensitive member is wholly exposed from the side of the transparent conductive substrate by the second exposing means. There are a plurality of units each of which includes such a charging means, first exposing means, developing means and second exposing means in the same or similar manner to each other. In each of such units, the electrostatic latent image being formed by the first exposing means is developed with a toner of one color of the three primary colors by the developing means. Finally, after the electrostatic latent image is developed by the developing means of the third unit, the electrostatic latent image is formed in the fourth unit and the same is developed by a black toner. In this embodiment, no second exposing means is provided in the third unit, and no charging means is provided in the fourth unit, because the reverse developing is made in respective developing means in the first through third units, but the normal developing is made in the fourth unit.

The objects and other objects, features, aspects and advantages of the present invention will become more apparent from the following detailed description of the embodiments of the present invention when taken in conjunction with accompanying drawings.

DETAIL DESCRIPTION OF THE DRAWINGS

Figure 3:
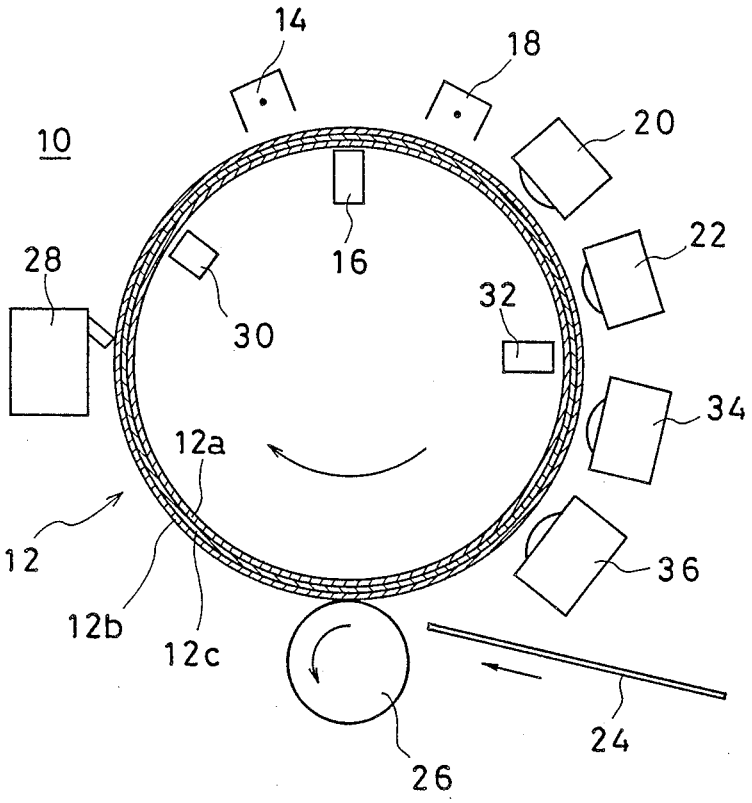
FIG. 3 is an illustrative view showing another embodiment in accordance with the present invention.
Figure 4A:
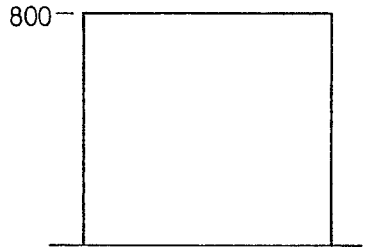
Figure 4B:
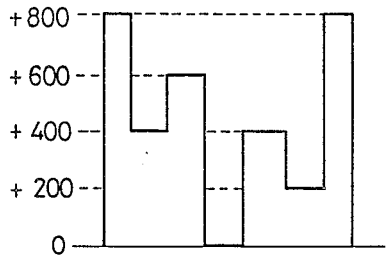
Figure 4C:
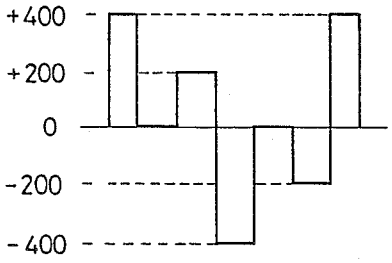
Figure 4D:
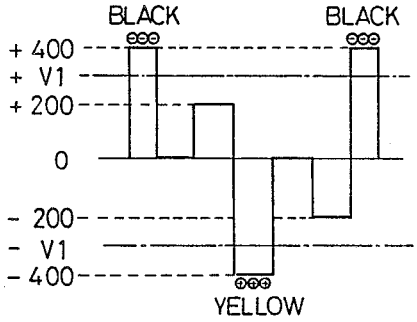
Figure 4E:
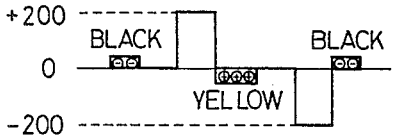
Figure 4F:
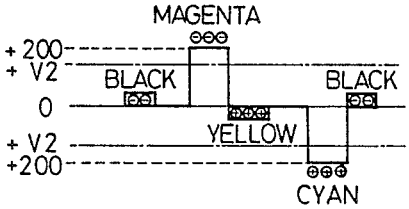

FIG. 4A FIG. 4F are illustrative views showing surface voltages of a photosensitive drum and states where toners are adhered in respective status, which can be referred to in describing operation of FIG. 3 embodiment.

Figure 5:
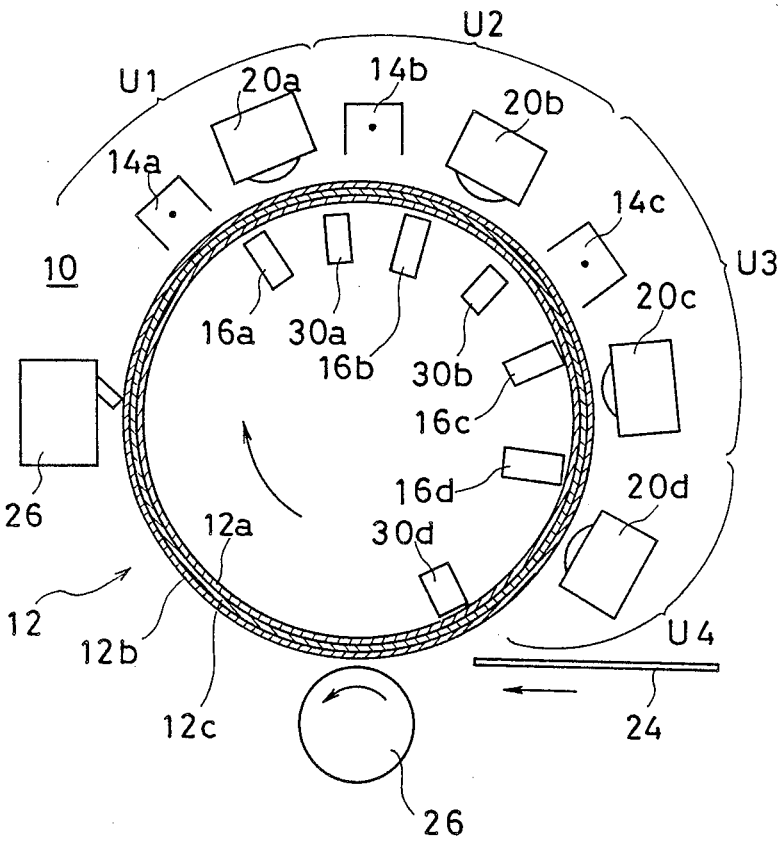

FIG. 5 is an illustrative view showing the other embodiment in accordance with the present invention.

FIG. 6A through FIG. 6J are illustrative views showing surface voltages of a photosensitive drum and states where toners are adhered in respective status, which can be referred to in describing operation of FIG. 5 embodiment.

Figure 7:
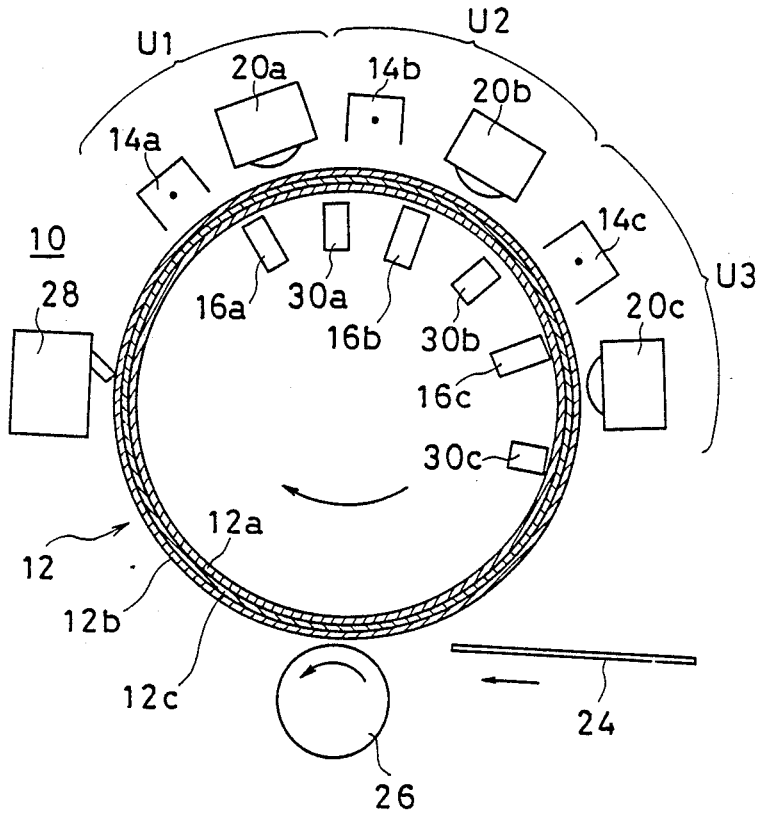

FIG. 7 is an illustrative view showing a modified example of FIG. 5 embodiment.

DETAIL DESCRIPTION OF THE PREFERRED EMBODIMENT

Figure 1:
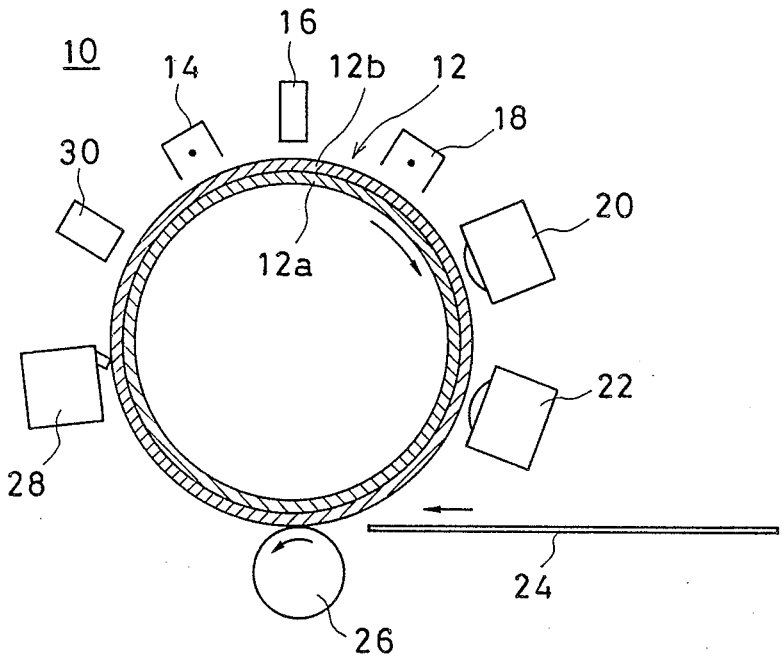
FIG. 1 is an illustrative view showing one embodiment in accordance with the present invention.

First, with reference to FIG. 1, an electrostatic recording apparatus 10 of this embodiment shown includes a photosensitive drum 12. The photosensitive drum 12 includes a substrate 12*a* made of electrical conductive material such as an aluminum and a photoconductive layer 12*b* formed on the substrate 12*a*. The photoconductive layer 12*b* is made of photoconductive material capable of being charged in the both polarities, that is , (+) and (−). More specifically, the photoconductive layer 12*b* is preferably made of photoconductive material which is mainly composed of an amorphous silicon. However, the photoconductive layer 12*b* may be formed by another material such as OPC (Organic Photosensitive Conductor) capable of being charged in the both polarities.

In the vicinity of a surface of the photosensitive drum 12*b*, a first charger 14 for uniformly charging the photosensitive drum 12 in one polarity is arranged. At the downstream from the first charger 14 in a rotational direction of the photosensitive drum 12, an LED array 16 is arranged. As well known, the LED array 16 includes a number of LED elements which are aligned in one line or a plurality of lines in a direction of width of the photosensitive drum 12. More specifically, in the embodiment shown, LED elements which can emit the light having wavelength of 600–750 nm are arranged at the density of 8–16 dots per 1 mm in the LED array 16. The light intensity, that is, an integrated value of the luminous flux of the light image from the LED array 16 can be set to strong or weak by controlling the current or light emitting time. Therefore, it is possible to simultaneously irradiate the light image having strong light intensity and the light image having weak light intensity onto the photosensitive drum 12 by the LED array 16.

At the further downstream from the LED array 16, a second charger 18 is arranged, which uniformly charges the photosensitive drum 12 in the reverse polarity opposite to that of the first charger 14. More specifically, the photosensitive drum 12 is charged at +700V by the first charger 14 and at −400V by the second charger 18. Therefore, after charging by the first charger 14, if the portion where no light is irradiated by the LED array 16 is charged by the second charger 18, the surface voltage of the portion becomes +300V as level-shifted.

At the downstream from the second charger 18, a first developer 20 in which a black toner being charged in the negative polarity (−) is accommodated, and at the further downstream therefrom, a second developer 22 in which a red toner being charged at the positive polarity (+) is accommodated are arranged, respectively.

A paper 24 being fed from a paper feeding portion (not shown) is sandwiched by a transfer roller 26 and the photosensitive drum 12, whereby a toner image developed by the first and second developers 20 and 22 is transferred onto the paper 24. The paper 24 onto which the toner images have been transferred is discharged through a discharging path (not shown) after fixing by a fixing device (not shown).

At the downstream of the transfer roller 26, a cleaning device 28 which removes the toner remaining on the photosensitive drum 12 after transferring, and an LED array 30 which eliminates the charge remaining on the photosensitive drum 12 are arranged respectively. The LED array 30 is operated as an erase lamp and thus always exposes the whole surface of the photosensitive drum 12.

Figure 2A:
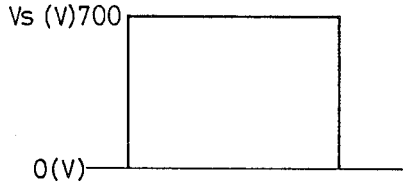
FIG. 2A through FIG. 2E are illustrative views showing surface voltages of a photosensitive drum and states where toners are adhered in respective status, which can be referred to in describing operation of FIG. 1 embodiment.

In operation, when the first charger 14 is enabled, the photosensitive drum 14 is uniformly charged at +700V, as shown FIG. 2A.

Figure 2B:
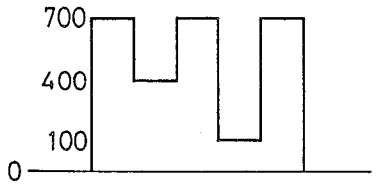

Thereafter, the light image from the LED array 16 is irradiated onto the photosensitive drum 12. The surface voltage of a portion of the photosensitive drum 12 whereto the light image having strong light intensity is irradiated is decreased to +100V, as shown in FIG. 2B. On the other hand, the surface voltage of a portion of the photosensitive drum 12 whereto the light image having weak light intensity is irradiated is decreased to +400V, as shown in FIG. 2B. Therefore, at this stage, electrostatic latent images of three gradations having different voltages (+700V, +400V and +100V) are formed on the photosensitive drum 12.

Figure 2C:
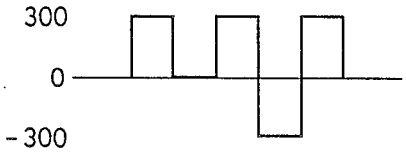

Thereafter, when the second charger 18 is enabled, the surface voltage of the photosensitive drum 12 is level-shifted in a direction to the negative polarity (−) by the charging voltage of −400V of the second charger 18, as shown in FIG. 2C. Therefore, the surface voltage of the portion of the photosensitive drum 12 whereto the light image having strong light intensity is irradiated becomes −300V (=+100−400V), the surface voltage of the portion whereto the light image having weak light intensity is irradiated becomes 0V (=+400−400V), and the surface voltage of a portion where no light is irradiated from the LED array 16 becomes +300V (=+700−400V).

Figure 2D:
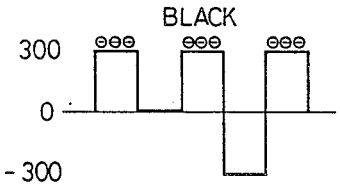
Figure 2E:
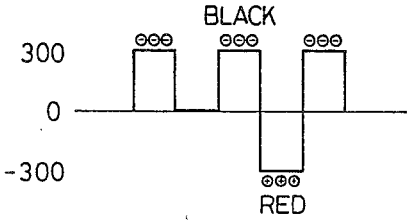

As described previously, in the first developer 20, the black toner being charged in negative polarity (−) is accommodated. Therefore, at the first developer 20, as shown in FIG. 2D, the black toner is adhered to the electrostatic latent image having the voltage of +300V such that a black toner image is formed on the surface of the photosensitive drum 12. In addition, since the red toner being charged in the positive polarity (+) is accommodated in the second developer 22, at the second developer 22, as shown in FIG. 2E, the red toner is adhered to the electrostatic latent image having the voltage of −300V.

Meanwhile, if suitable developing biases are respectively applied to the first and second developers 20 and 22, it is possible to effectively prevent the toner from being undesirely adhered to a portion having the voltage of 0V or the vicinity thereof.

Thus, in FIG. 1 embodiment, a two-color toner image is obtainable by executing a series of steps only one time. Therefore, in this embodiment, no light from the LED array 16 is irradiated to a portion to be reproduced with the black toner, and the light image having strong light intensity may be irradiated to a portion to be reproduced with the red toner.

With reference to FIG. 3, in this embodiment shown, the photosensitive drum 12 includes a substrate 12*a* made of transparent material such as a glass. The transparent substrate 12*a* may be made of a transparent electrical conductive material. However, if the transparent substrate 12*a* is formed by insulating material such as a glass, in order to ensure electrical conductivity with respect to the photoconductive layer 12*b*, transparent conductive film 12*c* is inserted between the transparent substrate 12*a* and the photoconductive layer 12*b*. As such transparent conductive film 12*c*, ITO, $SnO_2$ or the like can be utilized.

In this embodiment, a first LED array 16 is arranged at the downstream from the first charger 14, but the same is arranged inside the transparent substrate 12a. This means that the light from the first LED array 16 can be irradiated to the photoconductive layer 12b through the transparent substrate 12a and the transparent conductive film 12c. However, the first LED array 16 may be arranged outside the photoconductive drum 12.

In addition, in the first LED array 16, a number of LED elements having wavelength of 600–750 nm are arranged at the density of 8–16 dots per 1 mm. Then, the light intensity of the light image from the first LED array 16 can be set to four gradations having four kinds of the light intensity different from each other by controlling the current or light emitting time, as shown in FIG. 4B.

Then, at the downstream from the first LED array 16, the second charger 18 which is equal to that of FIG. 1 embodiment is arranged. At the downstream from the second charger 18, the first and second developers 20 and 22 are arranged. In this embodiment, a black toner being charged in negative polarity (−) is accommodated in the first developer 20, and in the second developer 22, a toner being charged in positive polarity (+) and having one color of the three primary colors in subtracting method is accommodated.

At the further downstream from the second developer 22, a second LED array 32 is arranged inside the photosensitive drum 12. The second LED array 32 irradiates the light to the photoconductive layer 12b through the transparent substrate 12a and the transparent conductive film 12c at a portion whereto the toner image has been formed by developing by means of the first and second developers 20 and 22. Thereby, the charge of the photoconductive layer 12b on the surface where the toner has been adhered by the first and second developers 20 and 22 can be eliminated by the second LED array 32. If the second LED array 32 is arranged outside the photoconductive drum 12, since the light from the second LED array 32 is irradiated to the photoconductive layer 12b from the side above the toner image, it is impossible to effectively eliminate the charge of the portion where the toners have been adhered. By contrast, when the second LED array 32 is arranged inside the photoconductive drum 12, as shown in this embodiment, the light is irradiated from the side below the toner image to the photoconductive layer 12b, and therefore, no problem due to insufficiency of elimination of the charge occurs.

At the downstream from the second LED array 32, third and fourth developers 34 and 36 are arranged outside the photoconductive drum 12. In the third developer 34, a toner being charged in the negative polarity (−) and having another color of the above described three primary colors is accommodated, and a toner being charged in the positive polarity (+) and having the remaining one of the three primary colors is accommodated in the fourth developer 36.

In addition, in this embodiment shown, an LED array or erase lamp 30 is also arranged inside the photoconductive drum 12.

In operation, first, when the first charger 14 is enabled, the photoconductive drum 12 is uniformly charged at +800V, as shown in FIG. 4A.

Next, when the photosensitive drum 12 is exposed by the light images of four gradations having four kinds of the light intensity by means of the first LED array 16, on the surface of the photosensitive drum 12, electrostatic latent images of five gradations having different voltages of +800V, +600V, +400V, +200V and 0V, respectively are formed as shown in FIG. 4B.

Next, when the second charger 18 is enabled, the surface voltage of the photoconductive drum 12 is wholly and uniformly level-shifted in a direction to the negative polarity (−) by −400V. Therefore, after operation of the second charger 18, the voltages of the electrostatic latent images of five gradations becomes +400V, +200V, 0V, −200V and −400V, respectively, as shown in FIG. 4C.

Succeedingly, the electrostatic latent images having the voltages as shown in FIG. 4C are developed by the first and second developers 20 and 22. In the first developer 20, the electrostatic latent image having the voltage of +400V is developed with the black toner being charged in the negative polarity (−), as shown in FIG. 4D. At this time, since the developing bias +V1 is applied to the first developer 22, the electrostatic latent image having the voltage of +200V which is lower than the developing baas +V1 cannot be developed at this stage, and therefore, in the first developer 20, only the electrostatic latent image having the voltage of +400V is developed with the black toner, as shown in FIG. 4D. In the same way, in the second developer 22, since the negative developing bias −V1 is applied to the second developer 22, only the electrostatic latent image having the voltage of −400V can be developed with the toner being charged in the positive polarity (+) and having one color of the three primary colors, for example, yellow.

Thereafter, by the second LED array 32, the light is irradiated to only a portion where the toner has been adhered in the previous step as shown in FIG. 4D through the transparent substrate 12a and the transparent conductive film 12c. Accordingly, the charge of the portion where the toner has been adhered is eliminated, and resultingly, the surface voltage of the photoconductive drum 12 becomes as shown in FIG. 4E. Therefore, only the electrostatic latent image having the voltage of +200V and the electrostatic latent image having the voltage of −200V both of which have not been developed in the developing step of FIG. 4D due to the developing biases +V1 and −V1 remain on the photoconductive drum 12.

Succeedingly, the electrostatic latent images of two gradations having the voltages as shown in FIG. 4E are respectively developed by the third and fourth developers 34 and 36. More specifically, since the toner being charged in the negative polarity (−) and having another color of the three primary colors, for example, magenta is accommodated in the third developer 34 and the developing bias +V2 as shown in FIG. 4F is applied to the third developer 34, in the third developer 34, as shown in FIG. 4F, the electrostatic latent image having the voltage of +200V is developed with the magenta toner. In the same way, in the fourth developer 36, the electrostatic latent image having the voltage of −200V is developed with the toner being charged in the positive polarity (+) and having the remaining one color of the three primary colors, for example, cyan.

Thus, when the respective electrostatic latent images have been developed by the first, second, third and fourth developers 20, 22, 34 and 36, respectively, a full-color toner image composed of the black and the three primary colors can be formed on the photosensitive drum 12.

In addition, the portion whereto the light image having relatively strong light intensity is irradiated by the LED array 16 as shown in FIG. 1, that is, the portion having the voltage of +400V as shown in FIG. 4B is level-shifted by −400V by the second charger 18 and becomes 0V, therefore, no toner is adhered to the portion, and therefore, when the toner image on the photosensitive drum 12 is transferred to the paper 24, at that portion, the color of the paper remains as it is.

With reference to FIG. 5, in this embodiment shown, the photosensitive drum 12 also includes the transparent substrate 12*a* and the transparent conductive film 12*c*. Then, in this embodiment, units U1, U2, U3 and U4 each of which has the same or similar structure with each other are arranged in association with the photosensitive drum 12.

The first unit U1 includes a charger 14*a*, first LED array 16*a*, developer 20*a* and second LED array 30*a*. The charger 14*a* is a charger for uniformly charging the photosensitive drum 12 at +400V, for example, being equal to the first charger 14 in the previous embodiment. The first LED array 16*a* is equal to the LED array 16 of the previous embodiment. In this embodiment shown, in order to make the whole of the electrostatic recording apparatus 10 be small, the first LED array 16*a* is arranged inside the photosensitive drum 12. However, the first LED array 16*a* may be arranged outside the photosensitive drum 12. The developer 20*a* develops the electrostatic latent image formed on the photosensitive drum 12 by the LED array 16*a* with, for example, a yellow toner being charged in the same polarity as the polarity of the electrostatic latent image. The second LED array 30*a* wholly eliminates the charge on the photosensitive drum 12 after developing by the developer 20*a*. Then, as similar to FIG. 3 embodiment, in this embodiment shown, the second LED array 30*a* is arranged inside the photosensitive drum 12 such that the charge on the portion whereto the toner has been adhered can be effectively eliminated.

The second unit U2 also includes a charger 14*b*, first LED array 16*b*, developer 20*b* and second LED array 30*b*. However, the third unit U3 includes only a charger 14*c*, first LED array 16*c* and developer 20*c* but does not include a second LED array. In addition, the fourth unit U4 includes only a first LED array 16*d*, developer 20*d* and second LED array 30*d* but does not include a charger.

The developers 20*a*–20*c* of the first through third units U1–U3 respectively make the reverse developing by using the toner of the three primary colors, but the developer 20*d* of the fourth unit U4 makes the normal developing by using the black toner. To this end, a second LED array or erase lamp is omitted from the third unit U3 and a charger is omitted from the fourth unit U4.

Figure 6A:
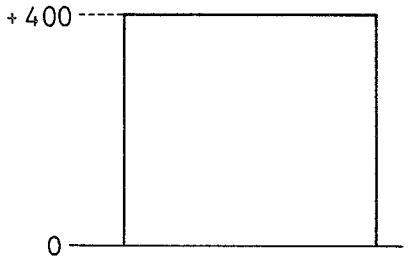
Figure 6B:
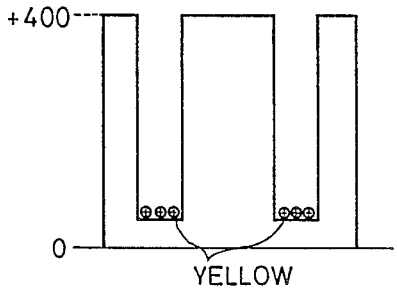
Figure 6C:
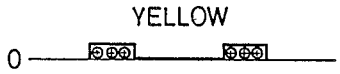

In operation, as shown in FIG. 6A, the photosensitive drum 12 is uniformly charged at +400V, for example by the charger 14*a* of the first unit U1. Succeedingly, as shown in FIG. 6B, an electrostatic latent image of one gradation is formed on the photosensitive drum 12 by the LED array 16*a*, and the electrostatic latent image is subjected to the reverse developing in the developer 20*a* with the yellow toner being charged in the positive polarity (+). Next, as shown in FIG. 6C, the charge on the photosensitive drum 12 including the portion where the yellow toner image has been adhered by the developer 20*a* is wholly eliminated by the second LED array 30*a*.

Figure 6D:
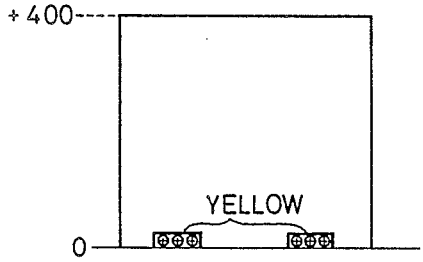
Figure 6E:
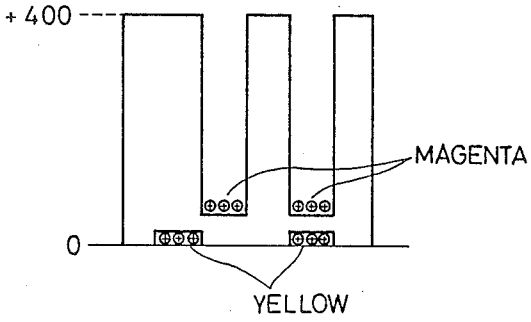

Thereafter, as shown in FIG. 6D, the photosensitive drum 12 is uniformly charged again at +400V by the charger 14*b* included in the second unit U2. Succeedingly, as shown in FIG. 6E, the electrostatic latent image is formed on the photosensitive drum 12 by the LED array 16*b*, and the electrostatic latent image is subjected to the reverse developing in the developer 20*b* with the magenta toner being charged in the positive polarity (+). Then, the charge on the photosensitive drum 12 is wholly eliminated by the second LED array 30*b*, as shown in FIG. 6F.

Figure 6F:
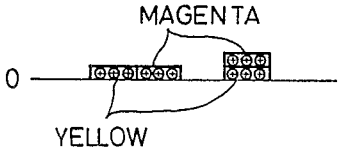

At this time, as shown in FIG. 6E and FIG. 6F, when the magenta toner is adhered to the portion whereto the yellow toner has been adhered in the previous unit U1, the portion is resultingly reproduced in color which is decided by color mixing in the subtracting method of two colors of toners yellow and magenta) being adhered in overlapped manner, for example, red, in this embodiment.

Figure 6G:
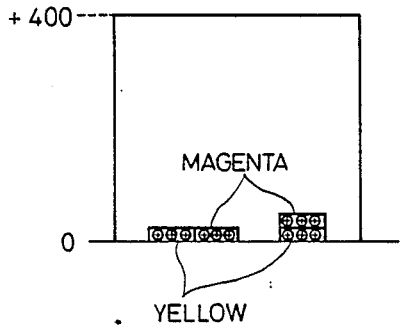
Figure 6H:
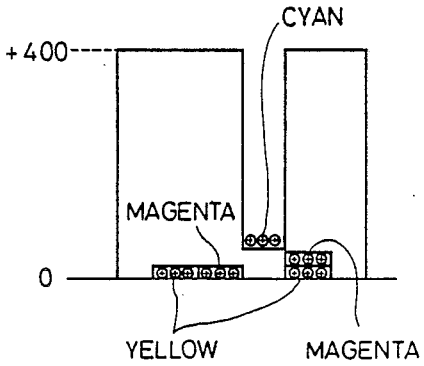

Thereafter, as shown in FIG. 6G, the photosensitive drum 12 is uniformly charged again at +400V by the charger 14*c* of the third unit U3. Then, as shown in FIG. 6H, the electrostatic latent image is formed on the photosensitive drum 12 by the first LED array 16*c*, and the electrostatic latent image is subjected to the reverse developing in the developer 20*c* with the cyan toner being charged in the positive polarity (+).

Figure 6I:
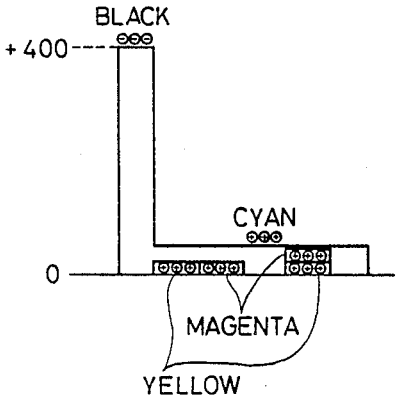

Thereafter, without wholly eliminating the charge on the photosensitive drum 12, the electrostatic latent image is formed by the first LED array 16*d* included in the fourth unit U4, as shown in FIG. 6I. At this time, the light from the first LED array 16*d* is irradiated to the photosensitive drum 12 such that the voltage of the portion where no toner is to be adhered by the developer 20*d* included in the fourth unit U4 can be lowered. Then, the portion where the voltage of +400V is maintained by the charger 14*c* of the third unit U3 is subjected to the normal developing in the developer 20*d* with the black toner being charged in the negative polarity (−).

Figure 6J:
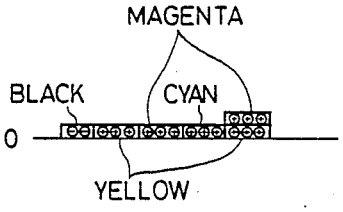

Thus, after wholly eliminating the charge on the photosensitive drum 12 by the second LED array 30*d*, a full-color toner image is formed on the photosensitive drum 12 as shown in FIG. 6J. The full-color toner image is transferred to the paper 24.

In addition, the toner cannot be adhered by the developer 20*d* on the portion whereto the light image is irradiated in the fourth unit U4, that is, the portion having low voltage in the positive polarity as shown in FIG. 6I, and therefore, when the toner image formed on the photosensitive drum 12 is transferred to the paper 24, the color of the paper remains as it is at that portion.

FIG. 7 shows a modified example of FIG. 5 embodiment, in this embodiment shown, no fourth unit is provided, and therefore, the developing by the black toner cannot be made. Then, in this embodiment, the black color is reproduced as a result of color mixing in subtracting method where the toners of the three primary colors are adhered in overlapped manner by the first through third unit U1 through U3.

In addition, in the respective embodiments as shown in FIG. 3, FIG. 5 and FIG. 7, the photoconductive layer 12*b* is exposed from the side of the transparent substrate 12*a* of the photosensitive drum 12. Therefore, the sensitivity of the photosensitive drum 12 becomes good. More specifically, in the case where the light is irradiated from the surface side of the photoconductive layer 12*a*, the light is absorbed at the vicinity of the surface of the photoconductive layer 12*b*, and electrons and holes are generated as movable carrier. If the photoconductive layer 12b has been charged in the positive polarity (+), when the photoconductivity is given to the same, the electrons and the holes respectively move to the surface of the photoconductive layer 12b and the substrate side thereof. This means that in the case where the light is irradiated from the surface side of the photoconductive layer 12b, the holes have to move from the surface of the photoconductive layer 12b to the substrate side thereof. By contrast, as done in the embodiments, when the light is irradiated to the photoconductive layer 12b through the transparent substrate 12a, the electrons as the movable carrier may move from the side of the substrate 12a of the photoconductive layer 12b to the surface side thereof. On the other hand, an amorphous silicon is used as the photoconductive layer 12b of the embodiments. In such an amorphous silicon, the moving degree of the electrons is larger than that of the holes, and therefore, in the case where the electrons move long distance as described above, it is possible to shorten the moving time of the carrier in comparison with the case where the holes move long distance. Therefore, when the photoconductive layer 12b is exposed from the side of the transparent substrate 12a of the photosensitive drum 12b, the sensitivity of the photosensitive drum 12 becomes good.

Meanwhile, an LED array is used as an exposing means in the above described embodiments, but such exposing means can be constructed by combination of another light emitting source and a liquid crystal shutter, for example. Furthermore, a laser beam can be also utilized for such an exposing means.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrostatic recording method, comprising the steps of:

(a) charging in one polarity a photosensitive member capable of being charged in both polarities;

(b) forming electrostatic latent images of two gradations having voltages different from each other by irradiating light images having two kinds of the light intensity different from each other to the photosensitive member being charged;

(c) charging the photosensitive member in the reverse polarity opposite to the polarity of the step (a); and (d) developing the electrostatic latent images of two gradations being formed on the photosensitive member immediately after the step (c).

2. A method in accordance with claim 1, wherein in said step (c), voltages of said electrostatic latent images of two gradations are level-shifted so as to become in opposite polarities to each other, in said step (d), the electrostatic latent image having the voltage of the negative polarity (−) is developed with a toner being charged in the positive polarity (+), and the electrostatic latent image having the voltage of the positive polarity (+) is developed with a toner being charged in the negative polarity (−).

3. An electrostatic recording apparatus, comprising:

a photosensitive member capable of being charged in both polarities;

first charging means for charging said photosensitive member in one polarity;

exposing means for forming electrostatic latent images of two gradations having voltages different from each other by irradiating light images having two kinds of the light intensity different from each other to said photosensitive member being charged by said first charging means;

second charging means for charging said photosensitive member in the reverse polarity opposite to the polarity of said first charging means such that the voltages of said electrostatic latent images of two gradations become in opposite polarities to each other; and developing means for developing the two electrostatic latent images of two gradations being formed on said photosensitive member and having the voltages in opposite polarities to each other immediately after said photosensitive member was charged by said second charging means.

4. An electrostatic recording apparatus, comprising:

a photosensitive member including a transparent conductive substrate and a photoconductive layer formed thereon;

uniform charging means for uniformly charging said photosensitive member;

first exposing means for exposing said photosensitive member being charged by said first charging means so as to form an electrostatic latent image;

developing means for developing the electrostatic latent image being formed on said photosensitive member by said first exposing means; and second exposing means for eliminating at least a part of the charge on said photosensitive member by irradiating the light to said photoconducive layer from the side of said transparent conductive substrate after the electrostatic latent image was developed by said developing means.

5. An electrostatic recording apparatus in accordance with claim 4, wherein said first exposing means includes means for forming electrostatic latent images of a plurality of gradations having voltages different from each other by irradiating light images having different kinds of the light intensity to said photoconductive layer, and said developing means includes means for developing a specific one of said electrostatic latent images of a plurality of gradations.

6. An electrostatic recording apparatus in accordance with claim 5, further comprising additional charging means for charging said photosensitive member which has been exposed by said first exposing means so as to level-shift the voltages of said electrostatic latent images, said developing means develops one of said electrostatic latent images being level-shifted by said additional charging means.

7. An electrostatic recording apparatus in accordance with claim 6, wherein said developing means constitutes a first developing means, further comprising second developing means for developing the other of said electrostatic latent images being level shifted by said additional charging means.

8. An electrostatic recording apparatus in accordance with claim 7, wherein said first and second developing means develop said electrostatic latent images with toners having different colors, respectively.

9. An electrostatic recording apparatus in accordance with claim 7, wherein electrostatic latent images of two gradations having voltages different from each other but in the same polarity are formed by said first exposing means, said additional charging means level-shifts the electrostatic latent image having relatively small voltage in absolute value of said electrostatic latent images of two gradations to the voltage in the reverse polarity.

10. An electrostatic recording apparatus in accordance with claim 9, wherein electrostatic latent images of three or more gradations having voltages different from each other but in the same polarity are formed by said first exposing means, said additional charging means level-shifts the electrostatic latent image having the smallest voltage in absolute value of said electrostatic latent images of three or more gradations to the voltage in the reverse polarity.

11. An electrostatic recording apparatus in accordance with claim 10, wherein electrostatic latent images of at least four gradations having voltages different from each other but in the same polarity are formed by said first exposing means, said additional charging means level-shifts the electrostatic latent image an intermediate voltage in absolute value of said electrostatic latent images having at least four gradations to the voltage of 0V or the vicinity thereof such that two electrostatic latent images can be level-shifted to different voltages in the positive polarity (+) and the remaining two electrostatic latent images can be level-shifted to different voltages in the negative polarity (−).

12. An electrostatic recording apparatus in accordance with claim 11, wherein said first developing means develops the electrostatic latent image having larger voltage in absolute value of said electrostatic latent images formed in the positive polarity (+) and the electrostatic latent image having larger voltage in absolute value of said electrostatic latent images formed in the negative polarity (−), and said second developing means develops the electrostatic latent image having smaller voltage in absolute value of said electrostatic latent images formed in the positive polarity (+) and the electrostatic latent image having smaller voltage in absolute value of said electrostatic latent images formed in the negative polarity (−).

13. An electrostatic recording apparatus in accordance with claim 12, wherein said first developing means includes two developers which respectively develop the electrostatic latent images with different color toners being charged in opposite polarities to each other.

14. An electrostatic recording apparatus in accordance with claim 13, wherein said second developing means includes two developers which respectively develop said electrostatic latent images with different color toners being charged in opposite polarities to each other.

15. An electrostatic recording apparatus in accordance with claim 14, wherein respective developers being included in said first and second developing means develop said electrostatic latent images with toners having colors different from each other, respectively.

16. An electrostatic recording apparatus in accordance with claim 15, said apparatus includes a plurality of units each of which includes said uniform charging means, said first exposing means, said first developing means and said second exposing means and has the same or similar structure with each other.

17. An electrostatic recording apparatus in accordance with claim 4, wherein said second exposing means wholly eliminates the charge of said photosensitive member.

18. An electrostatic recording apparatus, comprising:

a photosensitive member including a transparent conductive substrate and a photoconductive layer formed thereon; and a plurality of units arranged in association with said photosensitive member, each of said units respectively including uniform charging means for uniformly charging said photosensitive member, first exposing means for exposing said photosensitive member being charged by said uniform charging means, developing means for developing an electrostatic latent image being formed on said photosensitive member by said exposing means, and second exposing means for wholly eliminating the charge on said photosensitive member by irradiating light to said photoconductive layer from the side of transparent conductive substrate after said electrostatic latent image was developed by said developing means, whereby said electrostatic latent images may be developed by different color toners in respective developing means included in said plurality of units.

19. An electrostatic recording apparatus in accordance with claim 18, wherein said developing means included in any unit of said plurality of units includes reverse developing means for developing the electrostatic latent image being formed on said photosensitive member with a toner having the voltage in the same polarity.

20. An electrostatic recording apparatus in accordance with claim 19, wherein said developing means included in any unit of said plurality of units includes normal developing means for developing said electrostatic latent image being formed on said photosensitive member with a toner having the voltage in the opposite polarity.

21. An electrostatic recording apparatus in accordance with claim 20, wherein said plurality of units includes first, second, third, and fourth units and wherein said first and second units have the same structure, and said third unit includes only said uniform charging means, said first exposing means and said developing means, and said fourth unit includes only said first exposing means, said developing means and said second exposing means.

22. An electrostatic recording apparatus in accordance with claim 21, wherein said developing means of said first through third units respectively include reverse developers, and said developing means of said fourth unit includes normal developer.

23. An electrostatic recording apparatus in accordance with claim 22, wherein said developing means of said first through third units respectively include toners of one color of the three primary colors, and said developing means of said fourth unit includes a black toner.

24. An electrostatic recording apparatus in accordance with claim 18, wherein said plurality of units include three units having the same structure.

* * * * *